US010543949B2

(12) United States Patent
Niemuth

(10) Patent No.: US 10,543,949 B2
(45) Date of Patent: Jan. 28, 2020

(54) FOLDABLE CRATE SYSTEM

(71) Applicant: Kenneth K. Niemuth, Appleton, WI (US)

(72) Inventor: Kenneth K. Niemuth, Appleton, WI (US)

(73) Assignee: Dura-Fibre, LLC, Menasha, WI (US)

( * ) Notice: Subject to any disclaimer, the term of this patent is extended or adjusted under 35 U.S.C. 154(b) by 0 days.

(21) Appl. No.: 15/704,944

(22) Filed: Sep. 14, 2017

(65) Prior Publication Data

US 2018/0072451 A1 Mar. 15, 2018

Related U.S. Application Data

(60) Provisional application No. 62/395,106, filed on Sep. 15, 2016.

(51) Int. Cl.

| | |
|---|---|
| ***B65D 5/02*** | (2006.01) |
| ***B65D 5/42*** | (2006.01) |
| ***B31B 50/25*** | (2017.01) |
| ***B31B 50/20*** | (2017.01) |
| ***B31B 50/00*** | (2017.01) |
| ***B31B 50/14*** | (2017.01) |
| *B31B 100/00* | (2017.01) |
| *B31B 110/35* | (2017.01) |

(52) U.S. Cl.

CPC ..... *B65D 5/0281* (2013.01); *B31B 50/006* (2017.08); *B31B 50/146* (2017.08); *B31B 50/20* (2017.08); *B31B 50/256* (2017.08); *B65D 5/4266* (2013.01); *B31B 2100/002* (2017.08); *B31B 2110/35* (2017.08)

(58) Field of Classification Search

CPC .... B65D 5/0281; B65D 5/4266; B31B 50/20; B31B 50/006; B31B 50/146; B31B 50/256

See application file for complete search history.

(56) References Cited

U.S. PATENT DOCUMENTS

| | | | | |
|---|---|---|---|---|
| 3,039,372 A * | 6/1962 | La Bombard | B31F 1/08 | 493/396 |
| 3,649,398 A * | 3/1972 | Keith | B29C 53/063 | 156/79 |
| 3,913,822 A * | 10/1975 | Heaps, Jr. | B65D 5/04 | 229/122.32 |
| 5,337,916 A * | 8/1994 | Voss | B65D 5/4266 | 229/182 |
| 5,427,309 A * | 6/1995 | Voss | B65D 5/4266 | 229/182 |
| 6,029,884 A * | 2/2000 | Roeland | B65D 5/4266 | 206/455 |

* cited by examiner

*Primary Examiner* — Derek J Battisti

(74) *Attorney, Agent, or Firm* — Reinhart Boemer Van Deuren P.C.

(57) ABSTRACT

A foldable crate system, associated methods, and an associated apparatus are provided. The foldable crate system includes a continuous piece of paperboard having machined fold lines therein. The machined fold lines allow for highly precise folds of the paperboard to form the same into a packaging unit.

3 Claims, 17 Drawing Sheets

FOLDABLE CRATE SYSTEM

CROSS-REFERENCE TO RELATED PATENT APPLICATIONS

This patent application claims the benefit of U.S. Provisional Patent Application No. 62/395,106, filed Sep. 15, 2016, the entire teachings and disclosure of which are incorporated herein by reference thereto.

FIELD OF THE INVENTION

This invention generally relates to packaging, and more particularly to paperboard packaging.

BACKGROUND OF THE INVENTION

As is known in the art, paperboard is utilized to create packaging such as boxes or containers, as well as packaging support elements such as U-board or V-board support elements. Paperboard includes outer laminate sheets with a plurality of ply sheets interposed between the outer laminate sheets in a sandwich configuration. Such laminated paperboard is recognized as providing an economic and efficient packaging material. It is sufficiently strong such that it may be used in a variety of packaging applications.

One such packaging application is the packaging of long narrow products such as tubing, metal rods/extrusions, etc. Such products may be packaged with elongated crates. These elongated crates may comprise two elongated nesting halves, each of which has a U-shaped cross section normal to its length. These nesting crates are assembled into an elongated crate by arranging the halves such that their respective openings formed by their U-shape face one another. One half is inserted into the opening of the other half, such that an interior hollow space bound by four sides is formed.

When utilizing a relatively heavy product, e.g. metal bar stock, paperboard of sufficient thickness must be utilized to support the weight of the same. In lighter product applications, a sheet of paperboard is scored without completely severing the paperboard and folded along its score lines. However, in such heavier product applications, the paperboard is so thick that it cannot be scored and folded. Instead, the elongated nesting halves of such elongated crates are preformed via lamination into their final shape comprising the aforementioned U-shaped cross section. These preformed halves may then be assembled into their elongated crate configuration, and shipped to a customer for subsequent use in packaging applications.

Elongated product packaging may also be formed using separate panels of paperboard. Indeed, in such designs, separate panels of relatively thick paperboard are commonly affixed to an outer laminate sheet or sheets. A gap is formed between adjacent panels to allow space for folding the panels relative to one another.

While such elongated packaging configurations have proven effective, they are not without their drawbacks. With regard to the above referenced preformed configurations, as stated above such configurations are typically laminated into their final shape at their place of manufacture and then sent to customers for separate packaging of product and use. Shipping such packaging containers in their final shape, however, is costly as they are generally large and must be stacked or palletized together in their generally large final shape and sent to the customer.

Problems also exist with the above mentioned separate panel configurations. Indeed, an exemplary configuration of such a separate panel configuration may be seen at FIG. 1. As shown therein, two adjacent panels 12, 14 are commonly affixed to a laminate sheet 16. The panels 12, 14 are affixed to laminate sheet 16 such that a gap 18 is formed between panels 12, 14. This gap defines the region in which the panels 12, 14 will be folded relative to one another to form one fold or corner of the above-introduced U-crate.

FIGS. 2 and 3 show a resultant fold formed between panels 12, 14 in the region of gap 18. As can be seen therein, gap 18 and the relative placement of panels 12, 14 on laminate 16 can lead to panels 12, 14 deviating in direction 20 resulting in a relatively imprecise fold which is not a desired ninety degree angle. Upon formation of the fold, the panels 12, 14 are fixed in their folded configuration using any known technique in the packaging arts. Further, such separate panel configurations require the additional steps of cutting the panels of desired size, and affixing such panels to a common laminate sheet. Such additional steps are time and cost intensive.

Accordingly, there is a need in the art for a foldable crate system which overcomes the above disadvantages. The invention provides such a foldable crate system. These and other advantages of the invention, as well as additional inventive features, will be apparent from the description of the invention provided herein.

BRIEF SUMMARY OF THE INVENTION

In one aspect, the invention provides a foldable crate system that utilizes a continuous sheet of laminated paperboard with machined fold lines. The use of such machined fold lines provides for highly precise folds heretofore unobtainable in thick laminated paperboard constructions. An embodiment of such a foldable crate system includes a continuous sheet of laminated paperboard. The continuous sheet of laminated paperboard has a first side and a second side opposing the first side. A plurality of machined fold lines are formed into at least one of the first and second sides. The plurality of machined fold lines bound a plurality of sections of the sheet of paperboard. Each machined fold line includes a first face and a second face, the first and second faces arranged at about ninety degrees relative to one another.

In certain embodiments according to this aspect, each of the machined fold lines have one of a triangular or truncated triangular cross section. In certain other embodiments according to this aspect, the plurality of machined fold lines have identical cross sections. In embodiments according to this aspect, at least some of the plurality of fold lines are directly adjacent to one another.

In certain embodiments according to this aspect, the continuous sheet of laminated paperboard has a thickness and wherein each machined fold line of the plurality of machined fold lines extends into the continuous sheet of laminated paperboard to a depth which is less than the thickness of the continuous sheet of laminated paperboard.

In another aspect, the invention provides a method for manufacturing a sheet of paperboard for use as a foldable crate system. Such a method advantageously creates paperboard which may be utilized to form packaging for high strength applications. An embodiment of such a method includes providing a continuous sheet of laminated paperboard having a first side and a second side opposing the first side. The method also includes machining a plurality of machined fold lines into the first side and second side of the laminated paperboard. The plurality of machined fold lines are machined such that they are parallel to one another.

In certain embodiments according to this aspect, the step of providing the continuous sheet of laminated paperboard includes providing the continuous sheet of laminated paperboard having a thickness of about 0.080 inches to about 0.250 inches. The step of machining the plurality of fold lines may include machining at least some of the plurality of machined fold lines simultaneously. The step of machining the plurality of fold lines may also include machining each fold line of the plurality of fold lines such that it has a first face and a second face. The first face and second face may be arranged such that they are non-parallel to one another.

In yet another aspect, the invention provides a method for forming a foldable crate system. Such a method advantageously allows for the use of a single continuous sheet of relatively thick paperboard to be used for folding into a crate for packaging applications. An embodiment of such a method includes providing a continuous sheet of laminated paperboard. The continuous sheet of laminated paperboard has a plurality of sections separated by machined fold lines. The plurality of sections are arranged in a same plane relative to one another in an unfolded configuration of the continuous sheet of laminated paperboard. The method also includes folding the continuous sheet such that at least some of the plurality of sections are not arranged in the same plane relative to other ones of the plurality of sections.

In certain embodiments according to this aspect, the step of providing the continuous sheet of laminated paperboard includes providing the continuous sheet of laminated paperboard with machined fold lines which have cross sections which are identical. The step of providing the continuous sheet of laminated paperboard may also include providing the continuous sheet of laminated paperboard with machined fold lines each of which having a first face and a second face, the first and second faces arranged at about ninety degrees relative to one another.

In certain embodiments according to this aspect, the step of folding includes folding a first section of the plurality of sections about a machined fold line relative to a second section of the plurality of sections such that the first section is perpendicular to the second section. The step of folding may also include folding at least one section of the plurality of sections about a pair of machined folds lines which are directly adjacent one another.

In yet another aspect, an apparatus for forming a foldable crate system is provided. An embodiment of such an apparatus includes a frame. A plurality of rollers are mounted to the frame. The plurality of rollers are operatively arranged to feed a continuous sheet of laminated paperboard along a first direction. The continuous sheet of laminated paperboard has a first side and a second side. A plurality of cutting tools are mounted to the frame and movable relative to the frame in a second direction perpendicular to the first direction. The plurality of cutting tools are also movable in a third direction perpendicular to the first and second directions.

In certain embodiments, at least some of the cutting tools are arranged adjacent the first side of the continuous sheet of laminated paperboard. Additionally at least some of the cutting tools are arranged adjacent the second side of the continuous sheet of laminated paperboard. Each cutting tool of the plurality of cutting tools includes a motor and a rotary blade attached to the motor. The plurality of cutting tools are arranged such that the rotary blade of each cutting tool contacts the continuous sheet of laminated paperboard to remove material from the same. Each rotary blade has a peripheral cutting region which has one of a triangular or truncated triangular cross section.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
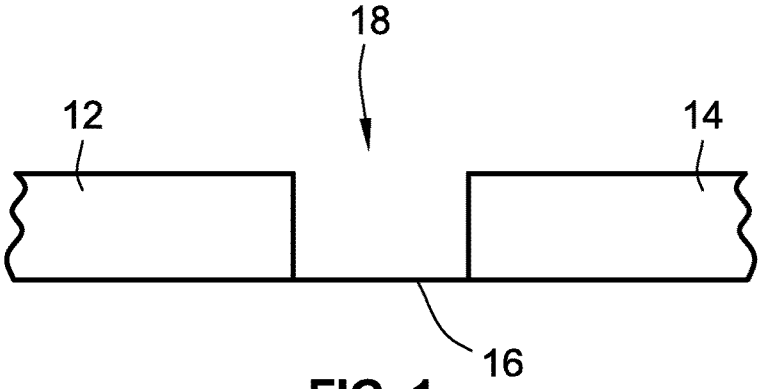
FIG. 1 (PRIOR ART)
FIG. 1 is a partial end view of a laminated paperboard assembly used for the manufacture of a known U-crate in an unfolded configuration.
Figure 2:
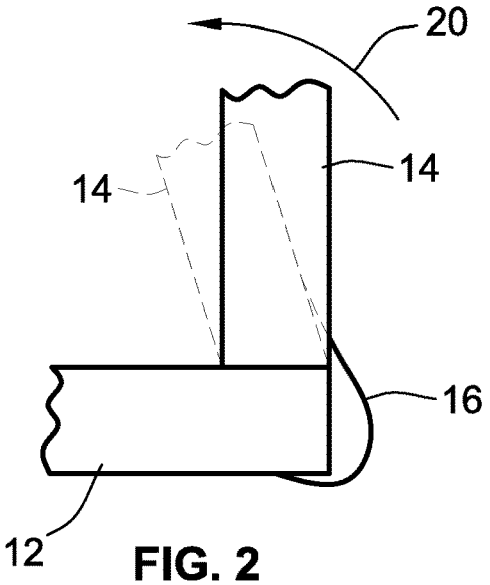
FIG. 2 (PRIOR ART)
FIGS. 2 and 3 are end views of the known assembly of FIG. 1 in folded configurations.
Figure 3:
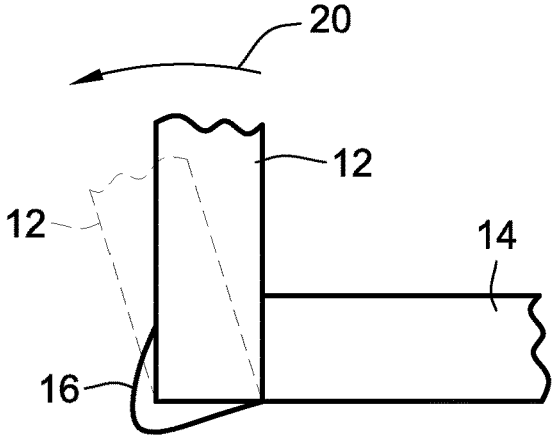
FIG. 3 (PRIOR ART)

Turning now to the drawings, exemplary embodiments of a foldable crate system, methods for its manufacture and use, and an apparatus for its manufacture are described herein. As will be understood from the following, the system, methods, and apparatus of this invention advantageously overcome the above problems associated with existing crate systems. In particular, the system described herein utilizes machined fold lines such that a continuous sheet of laminated paperboard may be utilized instead of preforms or a separate panel configuration as is shown in the known arrangement depicted in FIGS. 1-3.

These machined fold lines result in highly precise and strong folds. Further, because a continuous sheet of laminated paperboard it utilized, all that is required to form a crate, e.g. a U-crate, according to the teachings herein is to fold the same from an unfolded configuration into its desired folded configuration, and fix the same in its folded configuration. As a result, paperboard 32 may be shipped in its unfolded configuration in a simple stacked orientation. This is a notable improvement over the aforementioned preforms, which are typically manufactured into their final shape, and then shipped to an end user. With the embodiments herein, transitioning paperboard 32 from its unfolded configuration to its folded configuration is a simple and efficient process and thus can be done on-site at the end user's facility.

"Machined fold lines" is used herein to refer to fold lines which are formed with a cutting tool by removing material from an existing sheet of finished paperboard. Such machined fold lines are distinguished herein from fold lines created without material removal, e.g. by scoring, or arranging gap between adjacent panels. A "continuous sheet of laminated paperboard," as used herein, means a sheet of laminated paperboard which is not separated into separate panels but is instead a continuous piece of paperboard material formed using single piece outer laminate sheets which are free of gaps or breaks. A "continuous sheet of laminated paperboard" is also meant to include any precut lengths of laminated paperboard.

Figure 4:
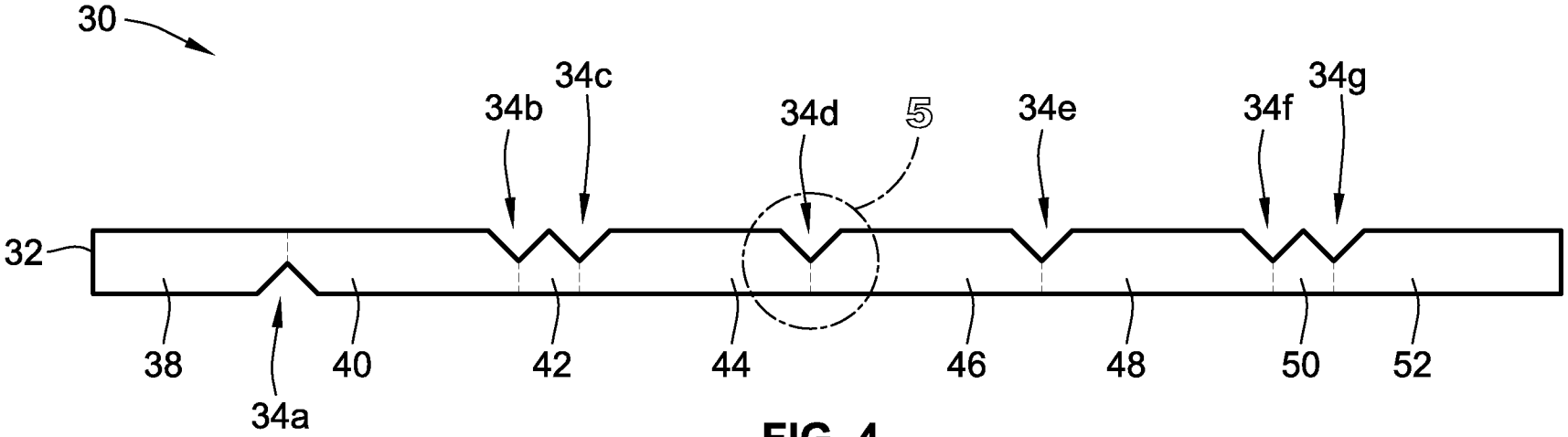
FIG. 4 is an end view of an exemplary embodiment of a sheet of paperboard of the foldable crate system of the invention herein, shown in an unfolded configuration.

Turning now to FIG. 4, an exemplary embodiment of a foldable crate system 30 is illustrated in an unfolded configuration. System 30 includes a continuous sheet of laminated paperboard 32 (referred to herein as "paperboard") with a plurality of machined fold lines 34*a*-34*g* (referred to herein as "fold lines") machined therein. Each fold line 34*a*-34*g* has a generally triangular or "V-shaped" cross section and does not extend entirely through paperboard 32. As can also be seen in FIG. 4, certain ones of fold lines 34*a*-34*g*, e.g. fold lines 34*b*-34*g* extend into a first face or side of paperboard 32, while certain other ones, e.g. fold line 34*a* extend into a second face or side of paperboard 32 opposite the first side. Unless otherwise noted herein, a description of one exemplary fold line applies equally well to the remaining fold lines. Although shown generally as terminating at a point, each fold line may also possess a flat bottom to facilitate folding. This flat bottom results in the fold line having a generally truncated triangular cross section. The advantages of such a flat bottom configuration are described below.

A dashed line is illustrated extending from the apex of each foldline 34*a*-34*g* to the immediately adjacent face or side of paperboard 32 to illustrate that paperboard 32 is subdivided into sections 38, 40, 42, 44, 46, 48, 50, and 52 for purposes of description. Sections 38, 40, 44, 46, 48, and 52 are generally planar sections, while sections 42, 50 have a shape, which at one side thereof, is an apex formed between directly adjacent fold lines 34*b*, 34*c* or 34*f*, 34*g*. "Directly adjacent fold lines" means fold lines which each have a side which converges to one another as can be seen at the aforementioned apexes. Fold lines 34*a*-34*g* may have completely identical cross sections. Alternatively, fold lines 34*a*-34*g* may have fold lines which are not necessarily dimensionally identical, but share a common geometric shape. Alternatively, it is also conceivable that fold lines 34*a*-34*g* could have cross sections which differ from one another in one or more of dimension, shape, depth, etc.

Figure 5:
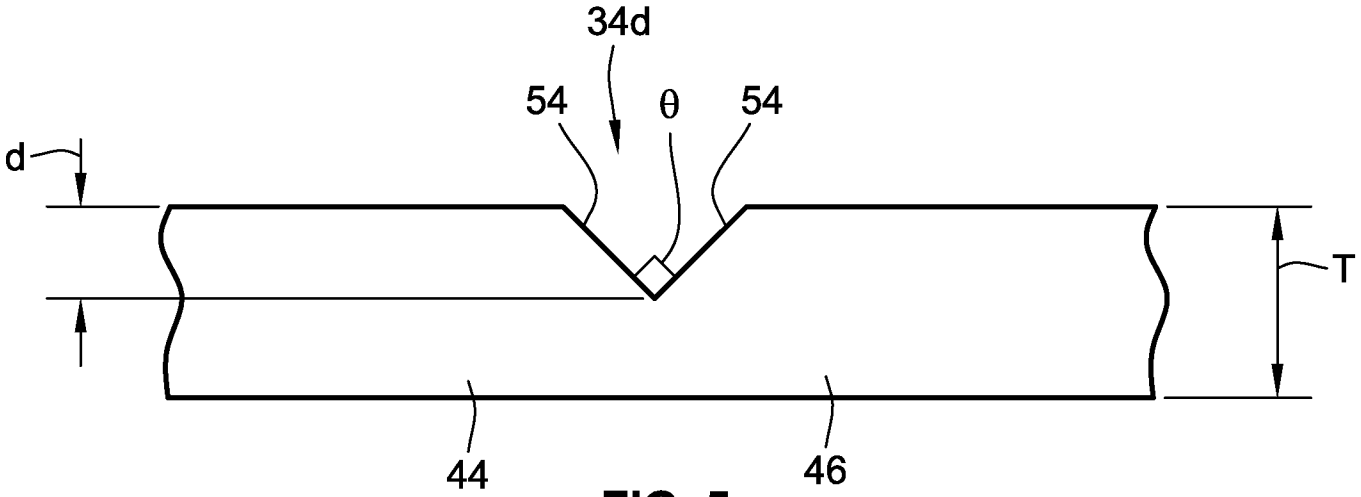
FIG. 5 is a partial end view of the sheet of FIG. 4, illustrating a machined fold line thereof.

Turning now to FIG. 5, the same illustrates paperboard 32 at fold line 34*b*. As can be seen in this view, paperboard 32 has an overall thickness T. Fold line 34*d* extends into paperboard 32 to a depth d. This depth d is less than the thickness T. Thickness T may be any thickness typically used for paperboard applications wherein relatively large or heavy objects are to be packaged. As one non-limiting example, paperboard 32 may have a thickness of about 0.080 inches to about 0.250 inches. The term "about" in this instance is used to allow for typical deviations in paperboard thickness known in the industry. However, it will be recognized from the teachings herein that the emplacement of the machined fold lines according to the invention are not limited to any particular paperboard thickness, and any thickness is contemplated herein.

Still referring to FIG. 5, fold line 34*d* has a generally triangular cross-section as shown. Fold line 34*d* comprises a first face 54 and a second face 56 which extend the length (taken normal to the page) of paperboard 32. These faces 54, 56 are arranged at an angle which is about 90°. It will be recognized from the teachings herein, however, that other angles other than about 90° may be utilized. For example, faces 54, 56 may simply be non-parallel to one another, or may even remain parallel to one another, dependent upon the desired fold configuration. The particular cross sectional shape of each fold line is determined by tool tip geometry, as may be readily appreciated. The term "about" in this instance is used to allow for angular deviations from the nominal value of angle theta shown in FIG. 5 of less than or equal to plus or minus 5°. This fold line 34*d* is arranged such that section 44 is foldable or displaceable about fold line 34*d* relative to section 46 to situate section 44 at a right angle relative to section 46. In other words, fold line 34*d* is arranged such that section 44 is displaceable out of the plane which it reside in its unfolded configuration. The same holds true for the remaining fold lines shown in FIG. 4. Of particular note directly adjacent fold lines 34*b*, 34*c* and 34*f*, 34*g* allow for displacing certain ones of the illustrated section out of the plane which they reside in in their unfolded configuration to a plane which is generally parallel to certain other ones of the illustrated sections.

Figure 6:
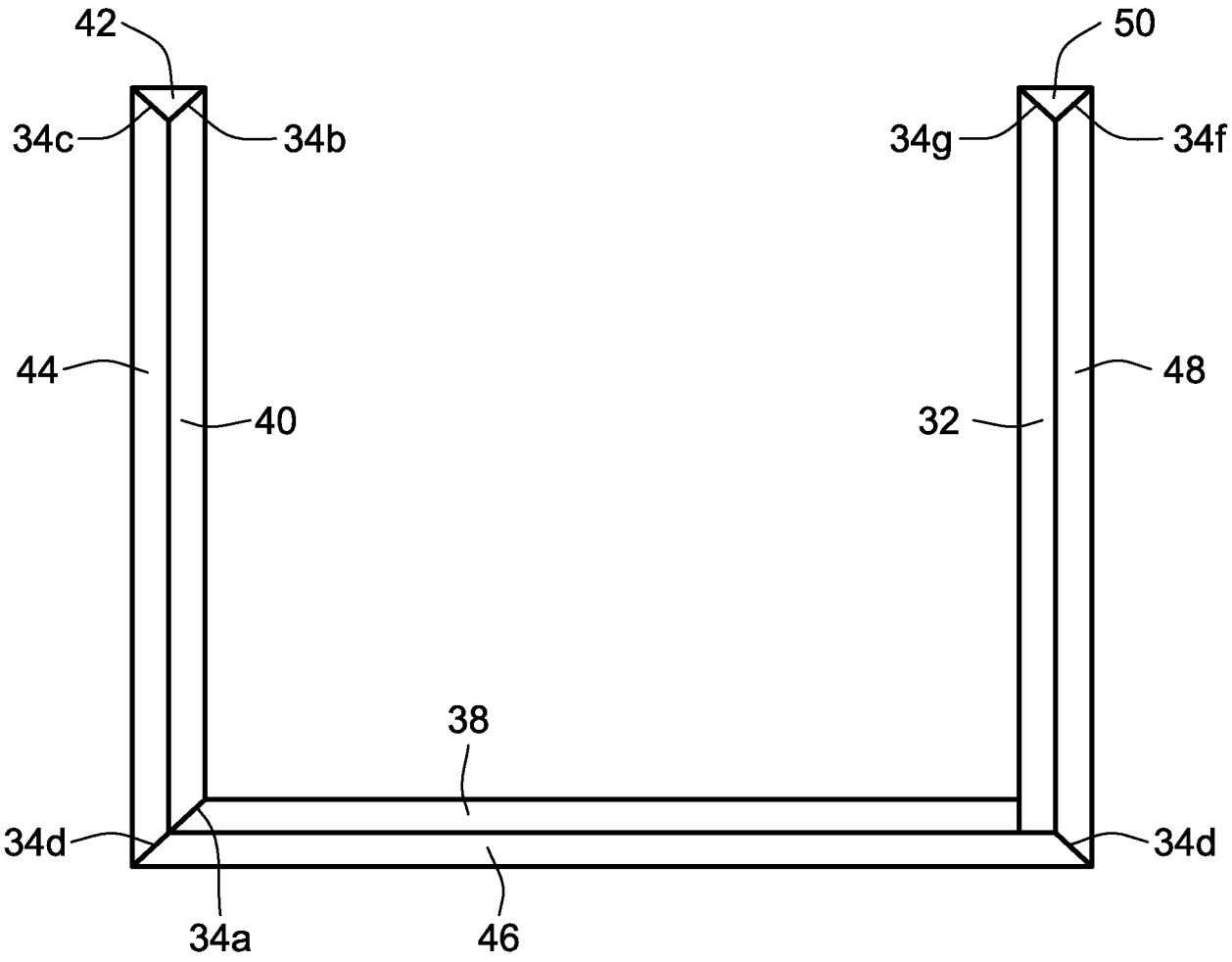
FIG. 6 is an end view of the sheet of FIG. 4, shown in a folded configuration.
Figure 7:
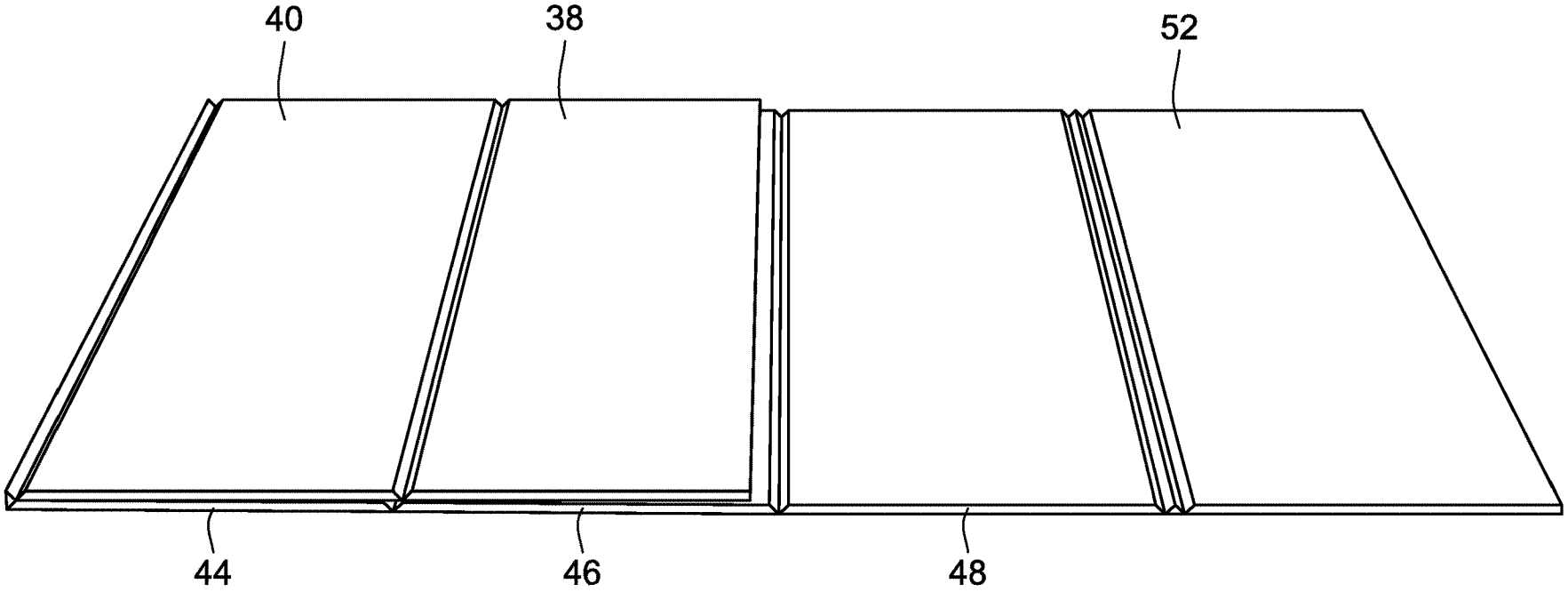
FIGS. 7-10 are perspective views illustrating the folding process for the sheet of FIG. 4 to transition the same from the unfolded configuration to the folded configuration.
Figure 8:
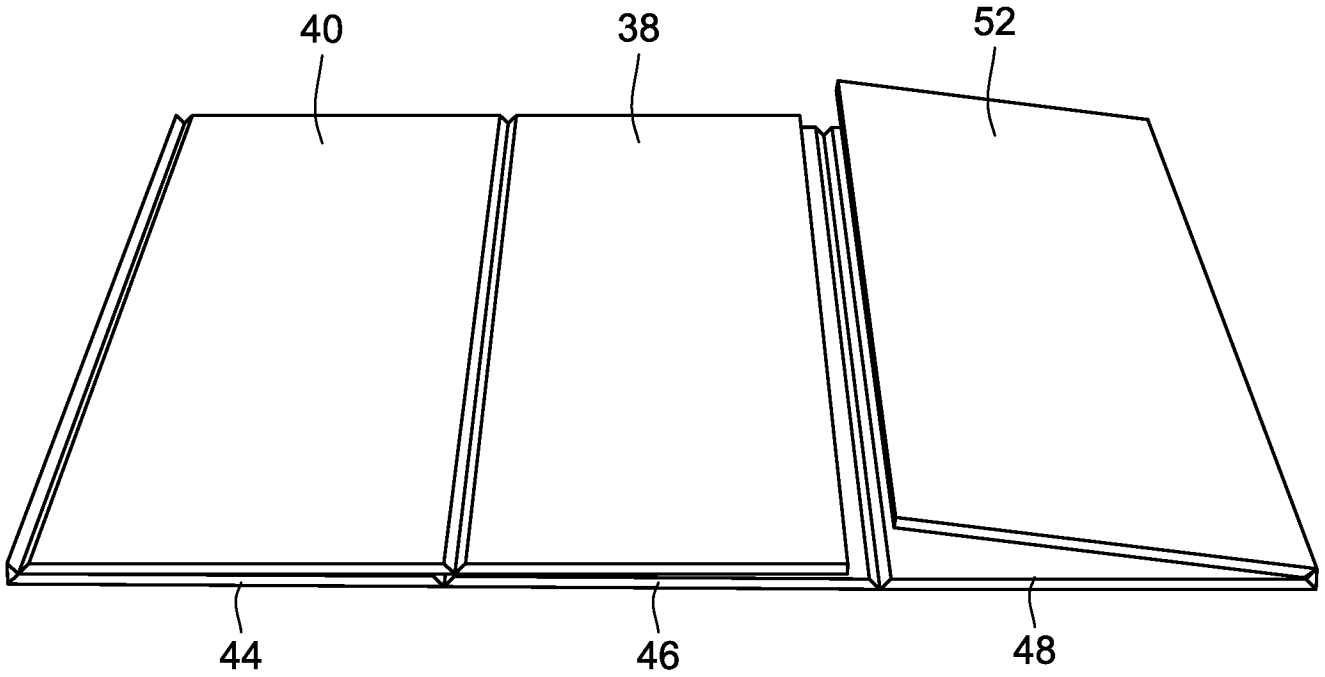
Figure 9:
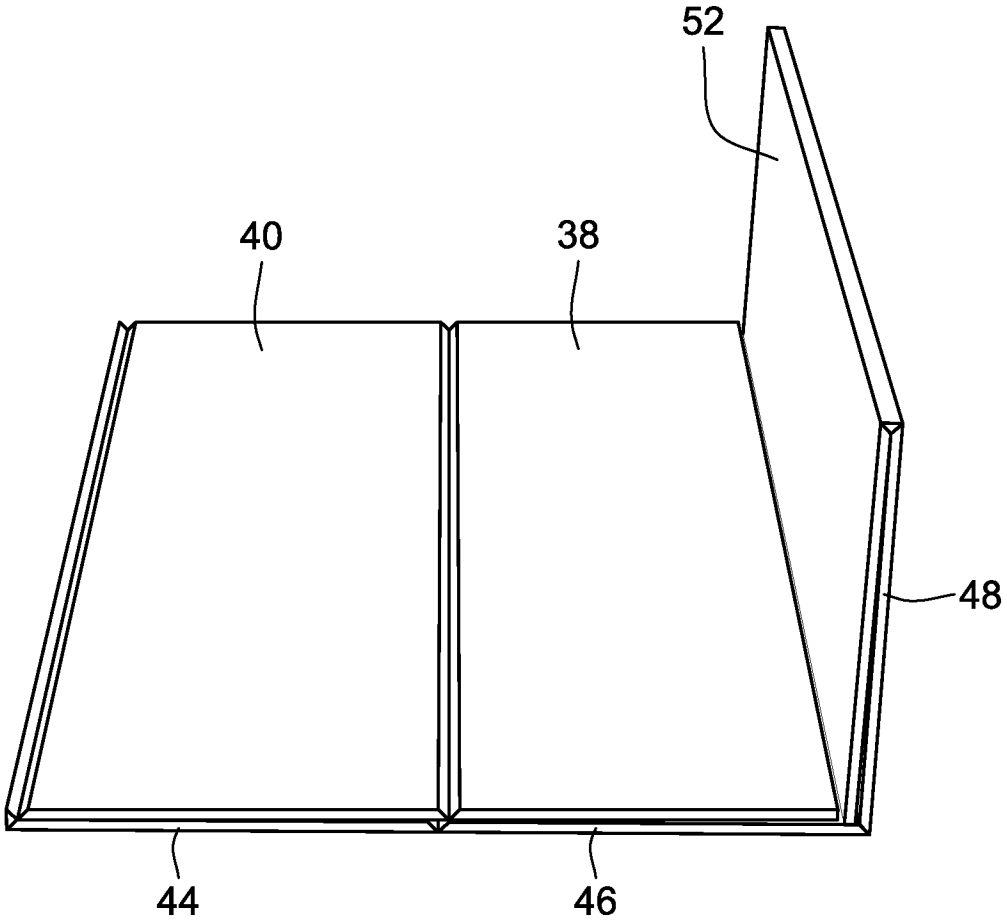
Figure 10:
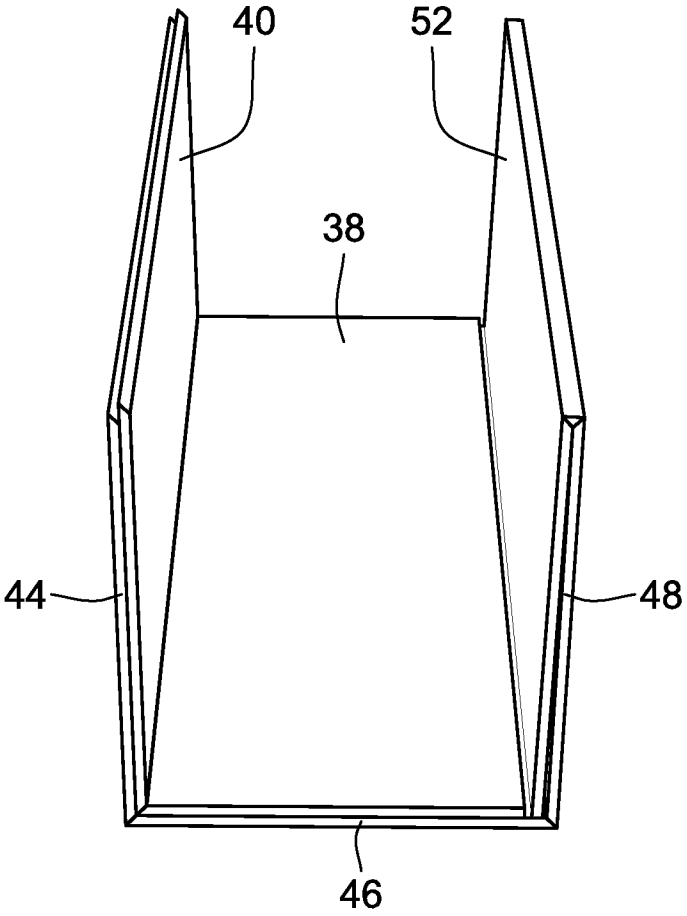

Turning now to FIG. 6, the same illustrates paperboard 32 in its fully folded configuration. In the illustrated embodiment, paperboard 32 has been folded into one-half of a U-crate packaging. Paperboard 32 may be fixed in this configuration by any known mechanical fixation means including screws, adhesives, tapes, etc. It will be recognized that a second paperboard 32 of larger or smaller dimension than what is shown in FIG. 6 may be folded such that it comprises the remaining half of the U-crate packaging.

Figure 11:
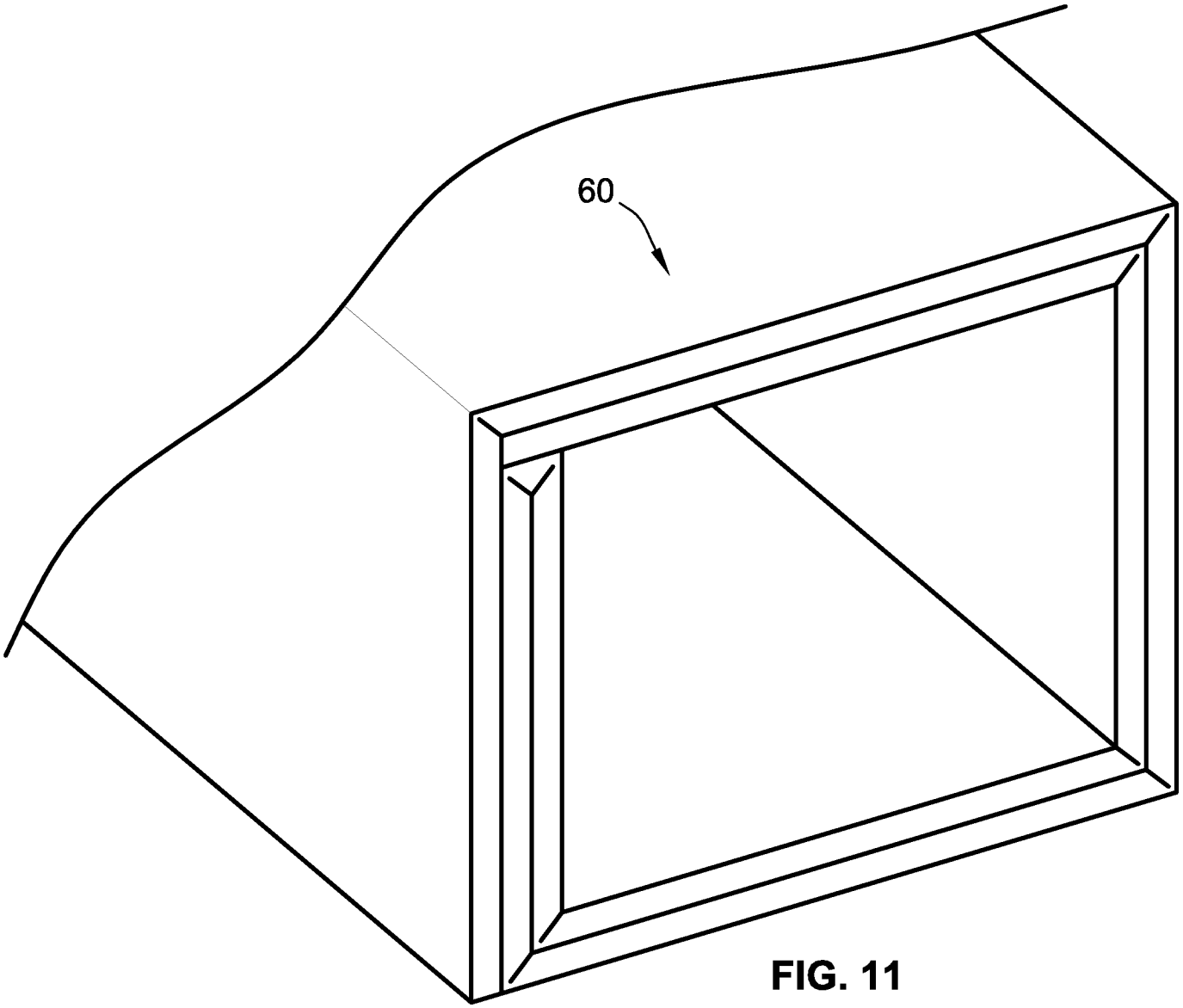
FIG. 11 is an exemplary embodiment of an assembled U-crate formed from two nesting crate halves, each of which using a sheet as shown in FIG. 4.

Indeed, FIG. 11 illustrates a fully formed U-crate 60 comprised to two respective halves formed by paperboard 32. This U-crate 60 has a hollow interior as shown which it configured to narrow elongated items therein. Although not shown, endcaps may be inserted into the respective ends of crate 60 to fully enclose the aforementioned interior space.

Figure 12:
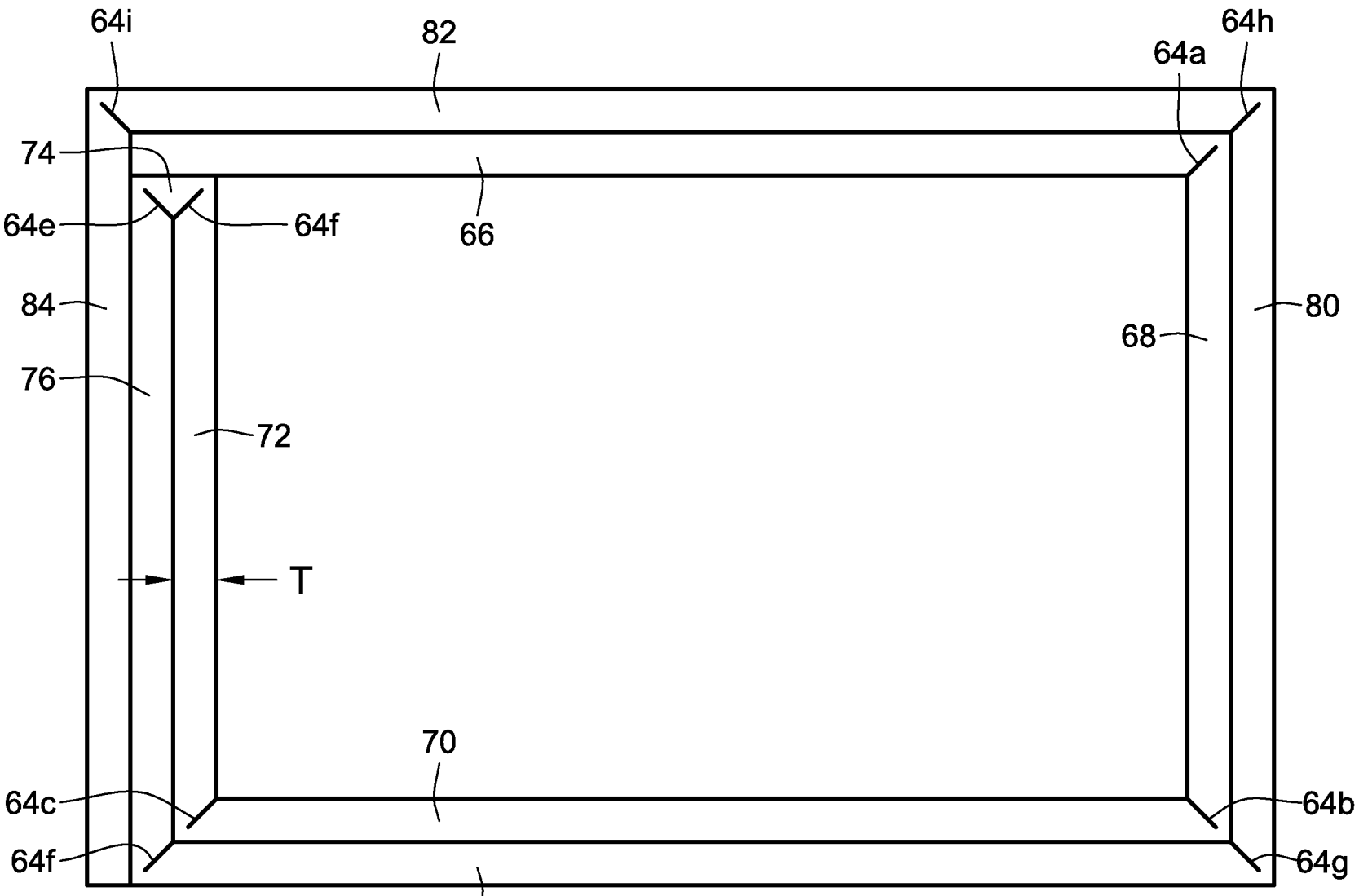
FIG. 12 is an alternative embodiment of a U-crate according to the teachings herein, which does not utilize crate halves and is instead formed from a single sheet.

The above-introduced machined fold lines advantageously allow for a flexible approach to forming various styles of packaging. For example, FIG. 12 illustrates a design which is similar to crate 60 shown in FIG. 11, except that it is formed from a single sheet of paperboard 32 and is not comprised of separate halves. Similar to the above-embodiment, this embodiment includes a plurality of machined fold lines 64*a*-64*i* which separate the paperboard into respective sections 68, 70, 72, 74, 76, 78, 80, 82, and 84. Deep fold lines and sections are the same in their shape and functionality as described above. As can be seen in FIG. 12, this embodiment also includes sidewalls which have a thickness 2T and a fourth sidewall with a thickness 3T. This allows for selectively varying the overall thickness of a crate or packaging form using the foldable crate system herein. For example, the side of the embodiment shown in FIG. 12 which has a thickness 3*t* may be arranged as the bottom-most side of a packaging to provide added strength against the side of the packaging which the product therein bears against under gravity. All that is required for such a selective design is a selection of the appropriate number and location of machine fold lines as described herein.

Figure 13:
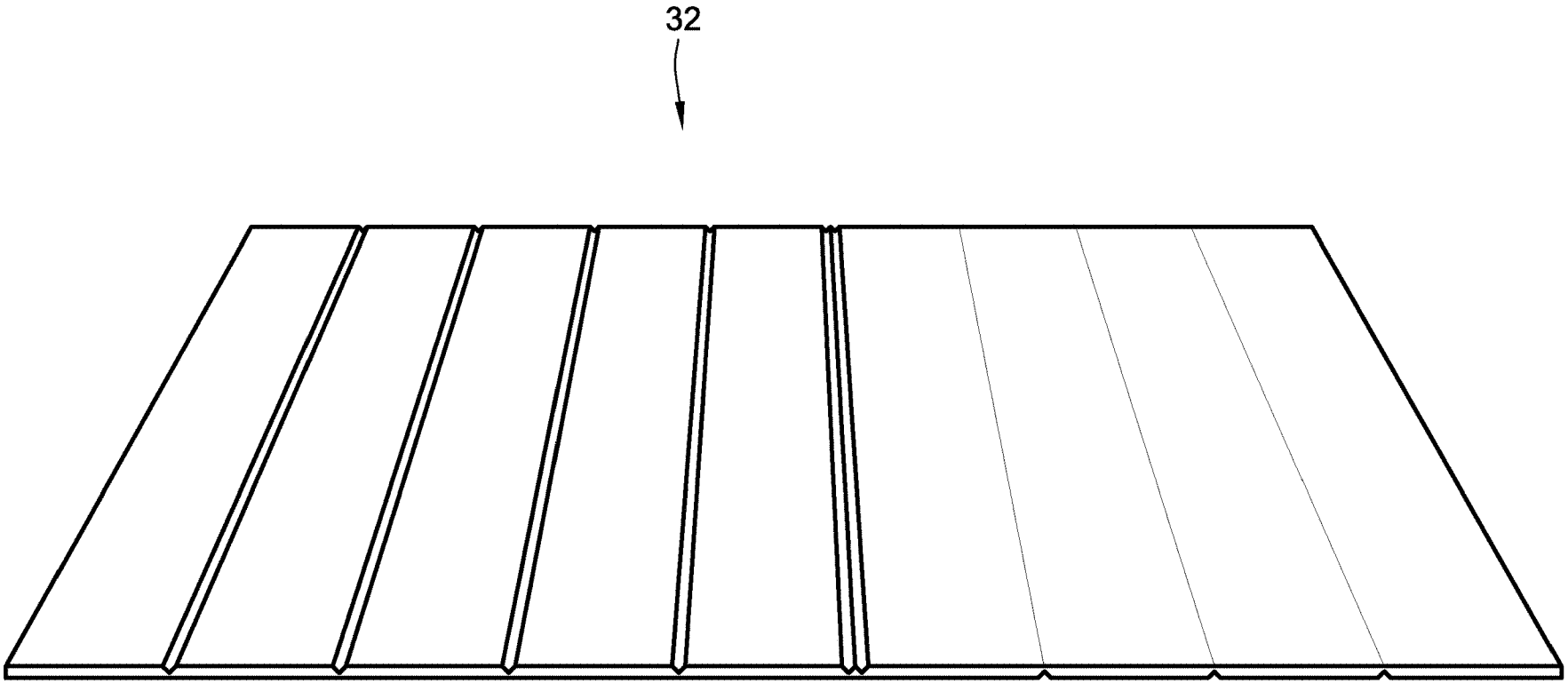
FIGS. 13-18 are perspective views illustrating the folding process for the sheet of FIG. 12 to transition the same from the unfolded configuration to the folded configuration.
Figure 14:
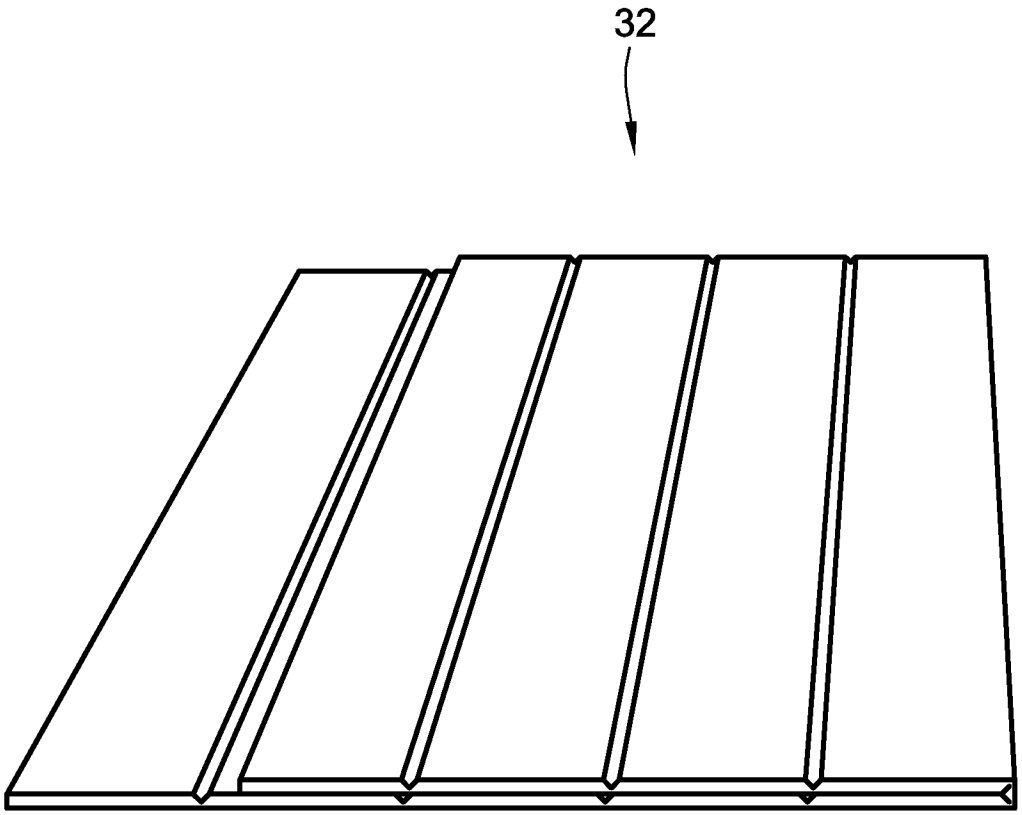
Figure 16:
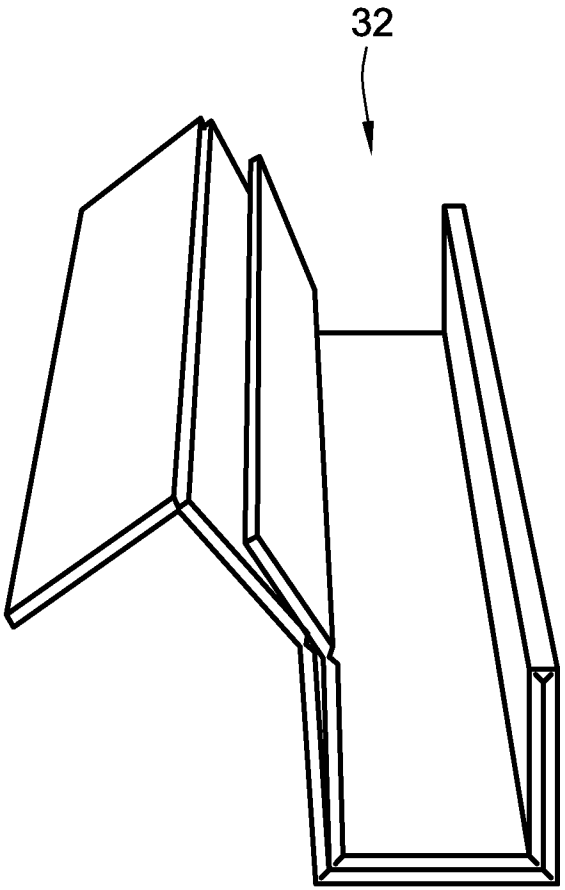
Figure 15:
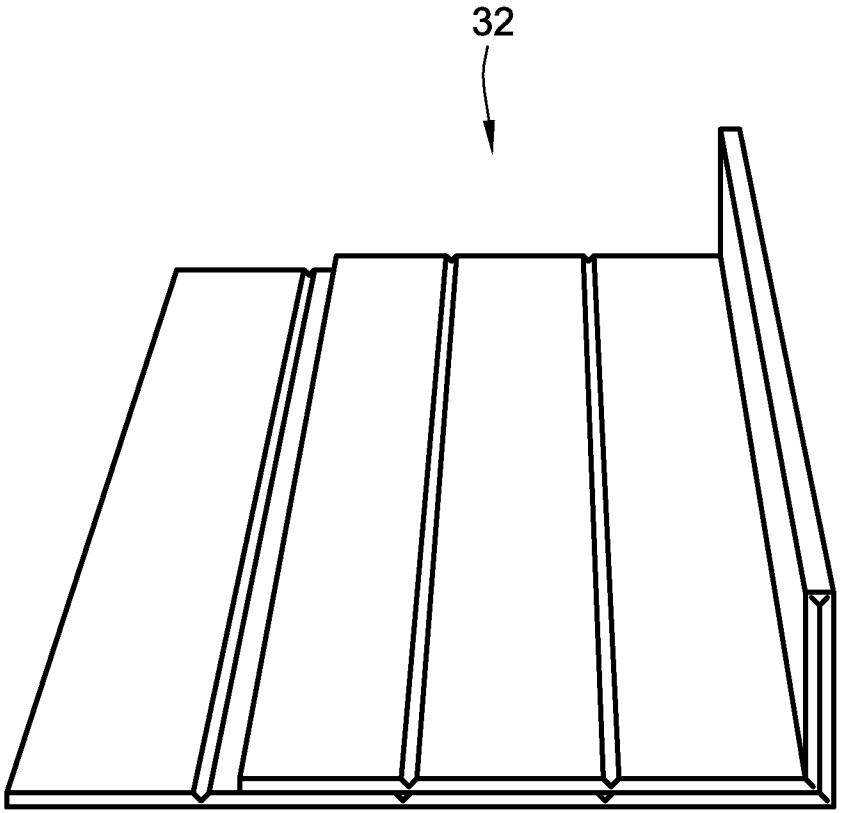
Figure 18:
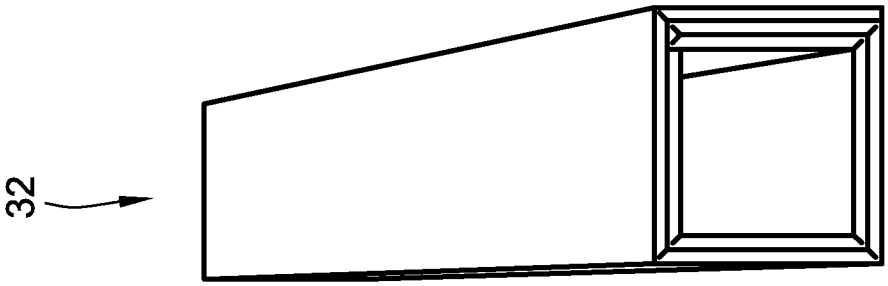
Figure 17:
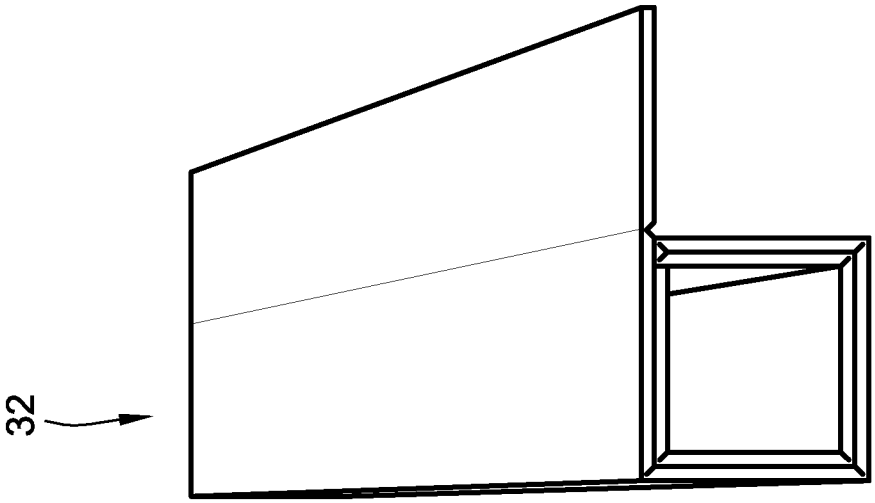

FIGS. 13-18 illustrate the various steps to take paperboard 32 according to the teachings herein from an unfolded configuration as shown in FIG. 13, to its folded configuration as shown in FIG. 12. It will also be recognized from comparison of FIG. 12 to FIG. 4 that the number and placement of fold lines is greater in FIG. 12 than in FIG. 4 to allow for the folded configuration shown in FIG. 12.

Figure 19:
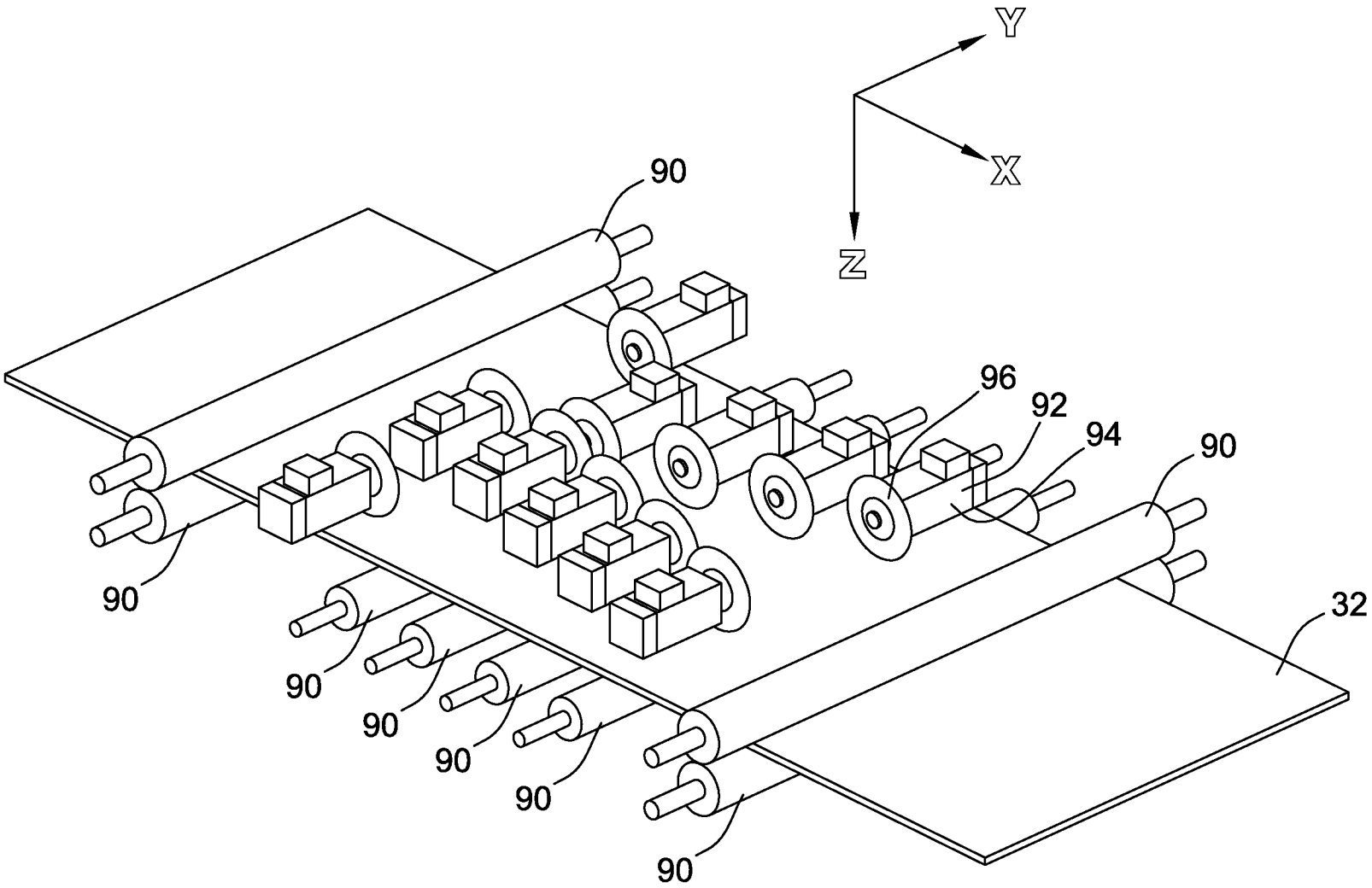
FIG. 19 is a partial perspective view of an apparatus for forming the foldable crate system of the invention herein.
Figure 20:
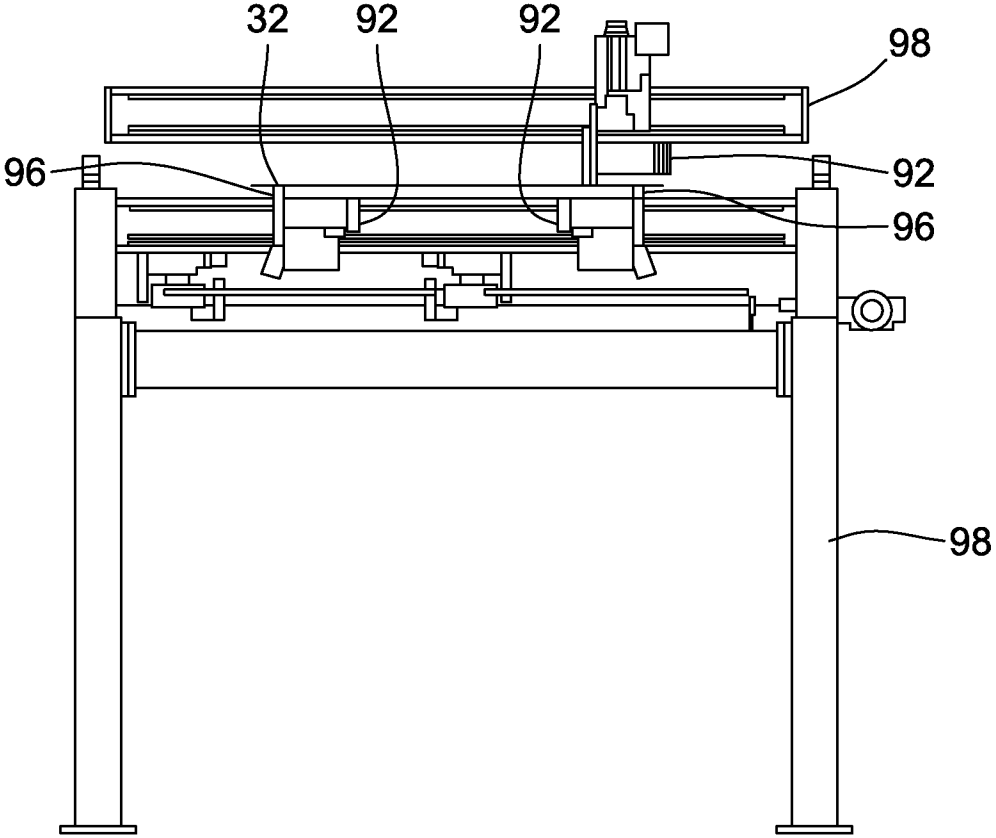
FIGS. 20 and 21 are front views of the apparatus of FIG. 19.
Figure 21:
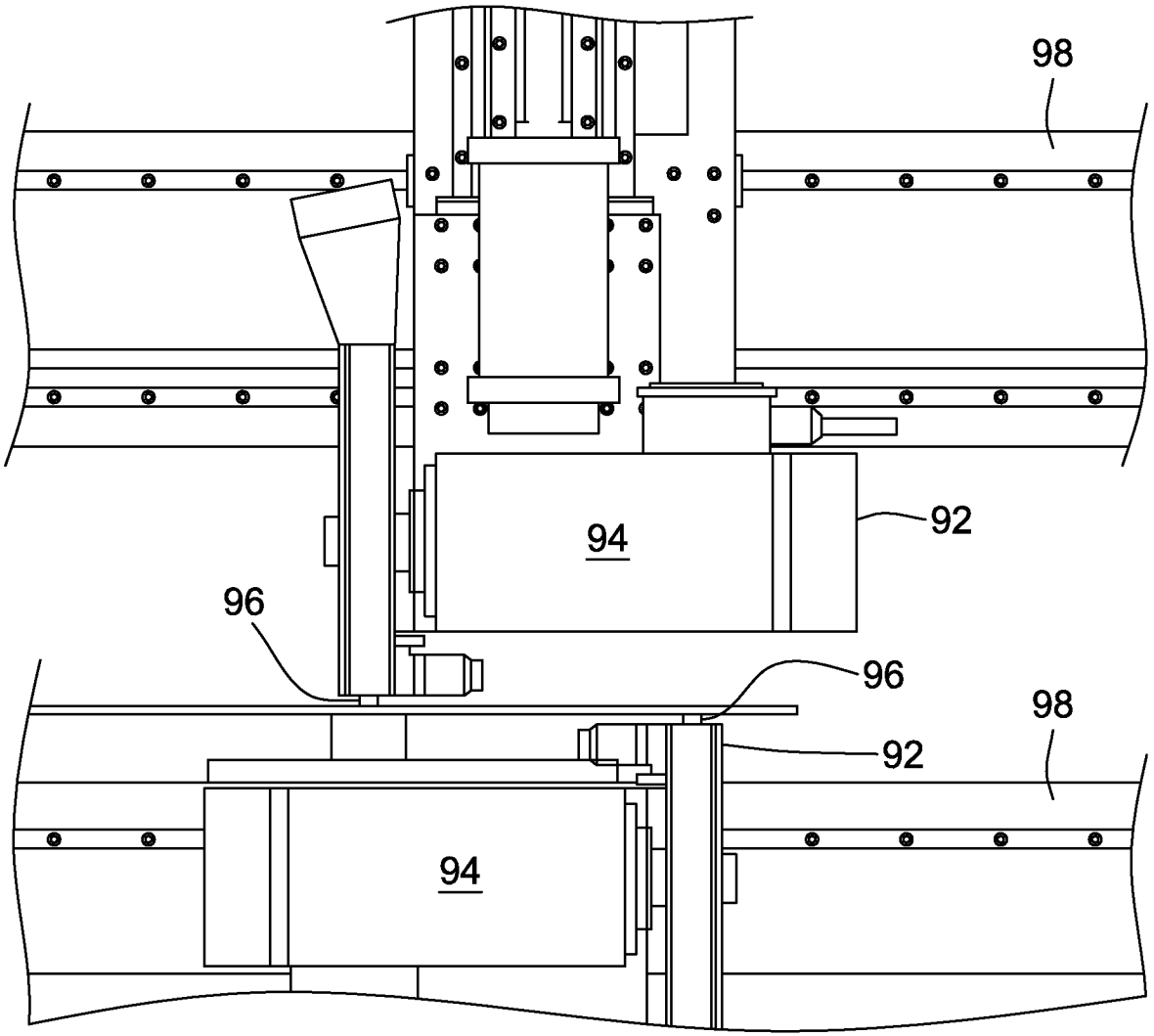

Turning now to FIGS. 19-21, the same illustrate one exemplary embodiment of an apparatus for machining paperboard into the foldable crate system 30 described above. With particular reference to FIG. 19, the apparatus can include a plurality of feed rollers 90 mounted to a frame 98 (See FIG. 20) for conveying a sheet of paperboard 32 in the X direction shown in FIG. 19. A plurality of cutting tools 92 are also mounted to frame 98 on either side of paperboard 32 and are movable in the Y direction to govern their relative spacing as well as the Z direction to govern their depth of cut into paperboard 32. With particular reference to FIG. 20, the same illustrates the aforementioned cutting tools 92 positioned above and below paperboard 32 such that machined fold lines may be cut into paperboard 32 on both sides thereof simultaneously. Although not shown in FIGS. 19-21, a controller may be associated with each of cutting tools 92 to govern the speed and other parameters thereof Turning now to FIG. 21, each cutting tool 92 includes a motor 94 and a rotary blade 96. Rotary blade 96 is generally shown in FIG. 21. However, in application, rotary blade 96 has a peripheral edge or cutting tip which assumes the same cross-sectional shape of the machined fold lines. Put differently, the shape of the outer peripheral edge of rotary blade 96 will govern the cross-sectional shape of each machine fold line.

In a typical operation, the cutting tools 92 are adjusted relative to frame 98 to their desired spacing and depth of cut locations. Paperboard 32 is then fed through the apparatus and the machine fold lines are cut therein during this feeding process. Thereafter, the length of paperboard 32 may be cut to length with an unshown cutting tool. After this cutting process is complete, paperboard 32 may be formed into its resultant packaging folding the same from an unfolded configuration to a folded configuration and then fixing it in this folded configuration. Alternatively, sheets of machined paperboard 32 may be shipped to a user for subsequent folding and fixation.

Figure 22:
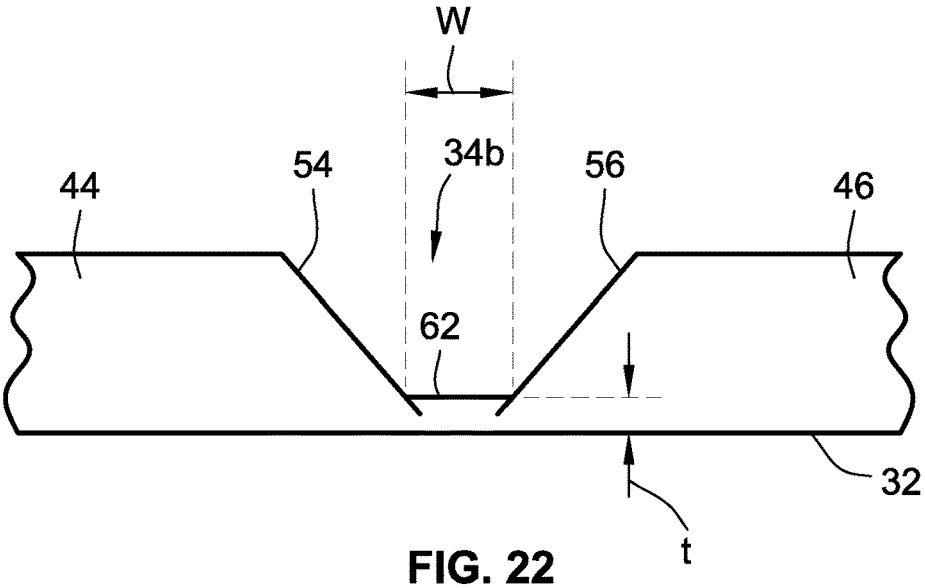
FIG. 22 is another partial end view of the sheet of FIG. 4, having an alternative fold line geometry.
Figure 23:
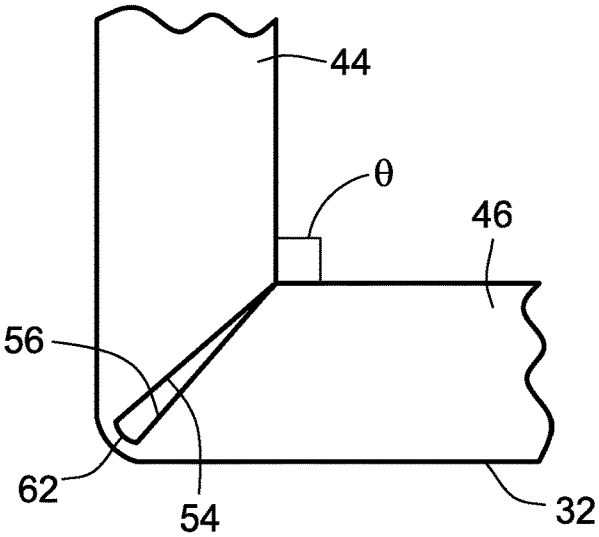
FIG. 23 is an exemplary fold using the fold line of FIG. 22.

Turning now to FIG. 22, the same illustrates an alternative configuration of fold line 34*d*. The primary difference from this fold line geometry and that shown in FIG. 5 is that fold line 34*d* includes a flat bottom 62 of width W and thickness t. This flat bottom 62 is incorporated to reduce the stresses on the remaining plies in this region when the same is folded. As the thickness tin this region below the flat bottom increases, so too must the width W of the flat bottom. Such a configuration allows for maintaining a desired bend radius of the remaining plies when folded into the configuration shown at FIG. 23.

Figure 24:
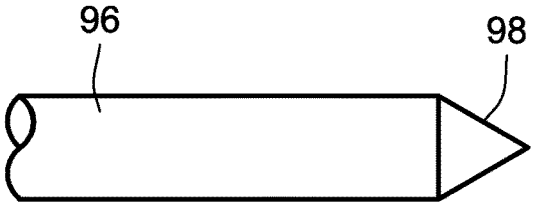
FIG. 24 is an partial view of a rotary blade used with the apparatus of FIG. 19.
Figure 25:
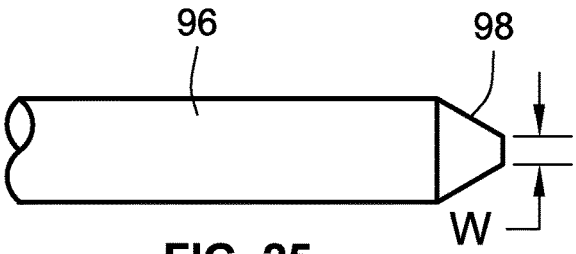
FIG. 25 is another partial view of a rotary blade used with the apparatus of FIG. 19.

As stated above, achieving the particular fold line geometry shown in this view is done by selecting a rotary blade 96 having a corresponding geometry. This is shown by way of example in FIGS. 24 and 25. In FIG. 24, rotary blade 96 has a cutting region 98 which is pointed in such that no appreciable flat bottom remains in a fold line using this tool. In FIG. 25, the same shows rotary blade 96 with a cutting region 102 which will allow for emplacement of a flat bottom 62 (see FIG. 22) of width W.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A foldable crate system, the foldable crate system comprising: a continuous sheet of laminated paperboard, the continuous sheet of laminated paperboard having a first side and a second side opposing the first side; a plurality of machined fold lines formed into at least one of the first and second sides, the plurality of machined fold lines bounding a plurality of sections of the sheet of paperboard; and wherein each machined fold line includes a first face and a second face, the first and second faces arranged at about ninety degrees relative to one another; wherein each one of the plurality of machined fold lines has a truncated triangular cross section with a flat bottom such that a portion of the first or second sides is removed at the base of the triangular cross section, the flat bottom having a width extending between the first and second faces, the flat bottom parallel to the first and second sides of the paperboard, and wherein a portion of the paperboard having a thickness that extends between the flat bottom and the first or the second side that is situated under the flat bottom and opposite the portion of the first or second sides that is removed at the base of the triangular cross section, wherein the width of the flat bottom is greater than the thickness of the portion of the paperboard under the flat bottom.

2. The foldable crate system of claim 1, wherein at least some of the plurality of fold lines are directly adjacent to one another.

3. The foldable crate system of claim 1, wherein the continuous sheet of laminated paperboard has a thickness and wherein each machined fold line of the plurality of machined fold lines extends into the continuous sheet of laminated paperboard to a depth which is less than the thickness of the continuous sheet of laminated paperboard.

* * * * *